US010707042B2

(12) United States Patent
Abdala

(10) Patent No.: US 10,707,042 B2
(45) Date of Patent: Jul. 7, 2020

(54) SWITCHING OPERATION MECHANISM FOR MOLDED CASE CIRCUIT BREAKER

(71) Applicant: WEG DRIVES & CONTROLS—AUTOMACAO LTDA, Jaragua do Sul (BR)

(72) Inventor: Joao Paulo Abdala, Jaragua do Sul (BR)

(73) Assignee: WEG DRIVES & CONTROLS—AUTOMACAO LTDA, Jaragua do Sul (BR)

( * ) Notice: Subject to any disclaimer, the term of this patent is extended or adjusted under 35 U.S.C. 154(b) by 0 days.

(21) Appl. No.: 16/088,930

(22) PCT Filed: Apr. 1, 2016

(86) PCT No.: PCT/BR2016/050073
§ 371 (c)(1),
(2) Date: Sep. 27, 2018

(87) PCT Pub. No.: WO2017/165932
PCT Pub. Date: Oct. 5, 2017

(65) Prior Publication Data

US 2019/0115181 A1 Apr. 18, 2019

(51) Int. Cl.
*H01H 71/56* (2006.01)
*H01H 3/40* (2006.01)
(Continued)

(52) U.S. Cl.
CPC ..... *H01H 71/56* (2013.01); *H01H 3/40* (2013.01); *H01H 9/28* (2013.01); *H01H 71/522* (2013.01)

(58) Field of Classification Search
CPC ..... H01H 71/56; H01H 71/522; H01H 3/40; H01H 9/28
(Continued)

(56) References Cited

U.S. PATENT DOCUMENTS 6,084,191 A 7/2000 Kataya et al. ..... 200/401
6,124,558 A 9/2000 Baumeister et al. ..... 200/501
(Continued)

FOREIGN PATENT DOCUMENTS

EP 1218914 3/2001
GB 1161310 8/1969
GB 2279810 A 1/1995

*Primary Examiner* — Edwin A. Leon
*Assistant Examiner* — Lheiren Mae A Caroc
(74) *Attorney, Agent, or Firm* — Harrington & Smith

(57) ABSTRACT

A switching operation mechanism to a molded case circuit breaker, including at least one operating handle, which is movable in a rotatable trajectory, said switching operation mechanism including at least one external rotary handle, at least one operation member and at least one movement transmission means, the said operation member being capable of moving in rotating trajectory in equivalent direction to the movement in rotating trajectory of the handle for operating the circuit breaker in molded case, arranged inside a housing including a laterally bipartite body, reaching an efficient movement transfer, requiring less mechanical effort of proportional operation of the user on the external rotary handle, wherein it is possible to maintain an external rotary handle, of great dimensions proportional to the assembled assembly, "within" the general perimeter of the molded case circuit breaker.

11 Claims, 11 Drawing Sheets

(51) Int. Cl.
*H01H 9/28* (2006.01)
*H01H 71/52* (2006.01)

(58) Field of Classification Search
USPC ..... 200/330–332
See application file for complete search history.

(56) References Cited

U.S. PATENT DOCUMENTS

| | | | | |
|---|---|---|---|---|
| 2002/0038759 | A1 | 4/2002 | Hamada et al. | 200/331 |
| 2002/0063049 | A1 | 5/2002 | Hamada et al. | 200/308 |
| 2005/0133352 | A1 | 6/2005 | Shin | 200/330 |
| 2006/0077023 | A1 | 4/2006 | Oh | 335/172 |
| 2014/0326585 | A1 | 11/2014 | Reinhart et al. | 200/43.11 |
| 2014/0346021 | A1* | 11/2014 | Baek | H01H 19/14 200/336 |

* cited by examiner

SWITCHING OPERATION MECHANISM FOR MOLDED CASE CIRCUIT BREAKER

This patent application is a U.S. National Stage application of International Patent Application Number PCT/BR2016/050073 filed Apr. 1, 2016, which is hereby incorporated by reference in its entirety.

FIELD OF THE INVENTION

The present invention belongs to the technological field of operating mechanisms of electrical protection switch operation by rotary component, and more particularly to a switching operation mechanism for a circuit breaker and a molded case, used to ease manual operation of the operating handle of a circuit breaker, or alternatively in applications to control panels, wherein the circuit breaker is inside thereof, and it is necessary to provide an extension, which is capable of providing alternate operation at the front portion of said panel.

In general terms, the switching operation mechanism to a circuit breaker in molded case, as disclosed herein, comprises a external rotary handle, a two-part structural housing, comprising an operation member cooperating with said external rotary handle, able to move in an analogous trajectory to the trajectory of the molded case circuit breaker.

BACKGROUND OF THE INVENTION

As well known to those skilled in the art, the circuit breakers currently known can have their operation based on thermal, magnetic, thermomagnetic or electronic principles, and can be used, above all, for the protection of electrical circuits subject to short circuits and/or electrical overloads generated by electric current peaks that exceed a nominal limit previously established, by the movement of electric contacts.

In this sense, it is verified that the circuit breakers function essentially analogously to the electrical switches, that is, they operate in order to change the electrical conduction state of an electric circuit between switched on and switched off. In addition to actuating automatically, the conventional circuit breakers also comprise an operating handle operated by a user. Such operating handles may further be coupled to switching operation mechanisms, which are used primarily in at least two situations: I) in circuit breakers for high current electrical circuits, wherein the force required to move the handle is usually relatively large for manual operations—especially in circuit breakers used in high current circuits, for example in the order of 1600 A; and II) in circuit breakers installed in panel housings which, for safety reasons, tend to be locked, which makes it difficult to directly access the circuit breaker, and wherein it is desirable that the operating handle of the switching operation mechanism is available on the external face thereof.

It is common to note in the prior art that most of these models and constructions of switching operation mechanisms to the circuit breakers are fundamentally based on the functional principle of mechanical cooperation between a pinion and a rack. Such functional principle is widely used in several fields of mechanics and widely known to those skilled in the art.

According to this operating principle, the pinion and the rack, physically coupled together, are usually disposed inside a protective enclosure, coupled to the circuit breaker and are associated with the circuit breaker operating handle. From this, a transmission of movements between these members occur, wherein the rotational movement of the external rotary handle of the switching operation mechanism, exerted manually by a user, triggers the rotational movement of the pinion and, consequently, the displacement of the linear trajectory of the rack, such displacement, which acts directly on the operating handle of the molded case circuit breaker, changing the operating position.

Based on of this context, it is possible to observe that such functional principle comprises some technically disadvantageous aspects.

A relevant technical aspect is that the rack, in its movement, moves in a linear trajectory, whereas the operating handle of the circuit breaker, due to its internal mechanism of action, moves in a rotating trajectory. In this sense, the interaction between these members causes a relative displacement between the rack of the switching operation mechanism and the handle for operating the circuit breaker, consequently, resulting in a high friction and a partial loss of the energy applied in the external rotary handle of said switching operation mechanism.

It should be noted that the cited movement of the handle for operating the molded case circuit breaker is internally rotating, such movement being due to its internal operation mechanism, which performs the opening and closing of its electrical circuit contacts, and observable in a lateral section plane. When the movement of an external rotating handle of the operation mechanism coupled to the molded case circuit breakers is reported, the said rotational movement is observed in the front operating plane.

STATE OF THE ART

Molded case circuit breakers are widely known in the prior art, comprising an operation handle that, mounted within the circuit breaker housing, protrudes out of the housing to provide manual operation of said circuit breaker.

The document US2006077023 discloses a circuit breaker in molded case comprising a switch on/off command mechanism and shot, comprising a movable rotary handle in the "A" or "B" directions for manually switching a circuit. Such condition is detailed in paragraph 40 of said document, in which it is further cited that the type of construction of the switching mechanism is well known, and for this reason further details have been omitted in the explanation. Another similar molded case circuit breaker is described in the document U.S. Pat. No. 6,084,191, especially in FIGS. 1 to 9. Such document also reports the existence of an operating handle (showing the circuit breaker in the side section plane) capable of visible movement in a rotational trajectory in their stages of operation. These types of circuit breaker in molded case, as in document US20060077023 or U.S. Pat. No. 6,084,191 is the type used together with the invention.

Switching operation mechanisms used to facilitate the switch on/off operation of molded case circuit breaker already encompassed by the prior art.

A constructive example is described in document EP1218914, whereby said switching operation mechanism is essentially comprised of two cooperating gears to each other, one large and one small that, combined, analogously operate a pinion and a rack. It is further provided an external rotary handle associated with the large gear, and in addition, it is noted that the rotational movement of the gears (imposed by the rotational movement of the external rotary handle triggers the linear trajectory displacement of the rack capable of moving the operating handle of the circuit breaker coupled thereto.

Other switching operation mechanisms containing similar actuating levers exist, as foreseen in the document GB 1161310, which describes an accessory mechanism containing rack and pinion, both used in order to facilitate the operation of the operating handle of the molded case circuit breaker or promote the transfer of the operating handle of a circuit breaker, located at the backside of a panel for the front of the operation.

Furthermore, the document GB 2279810 also discloses a coupling actuation mechanism in rectangular shape, comprising a locking system and a handle displaced from the center of the circuit breaker operating handle, a gear and an internal lever containing a gear hole. Such a mechanism has the disadvantage that due to the construction of said inner lever be displaced from the center of rotation of said rotary handle of the mechanism the force required to operation the rotary handle of the mechanism is greater than the force required to move the operating handle of the circuit breaker itself.

In the prior art documents it can be seen that the switching operation mechanisms for operating the handle of a circuit breaker fail to provide the contact between the internal mechanism and the circuit breaker handle for it does not follow its rotational movement.

Accordingly, it is verified that the present state of the art comprises a wide variety of designs and constructions of switching operation mechanisms for molded case circuit breakers, which have failed to solve imperfections in the movement transfer system between an operating handle of a molded case circuit breaker and a switching operation mechanism.

OBJECTS OF THE INVENTION

Therefore, it is an object of the invention to disclose a switching operation mechanism for molded case circuit breaker, the transmission medium of which is capable of developing a movement or displacement of a trajectory analogous to the reversible rotary trajectory of the operating handle of a circuit breaker, or similarly, whose transmission medium is capable of developing a movement or displacement with a rotating or arc-shaped trajectory.

It is also an object of the invention to provide a operation mechanism for circuit breaker free from disadvantageous technical aspects observed in the prior art constructions and, more particularly, exempted from technical aspects related to the inefficient transfer of movement and to the high wear of parts of the moving components.

Another object of the invention is to use a bevel gear system, which increases the lateral compaction of the switching operation mechanism to a circuit breaker.

Another object of the invention is that a switching operation mechanism for circuit breakers in molded case does not exceed their lateral dimensions.

Another object of the invention is that the housing construction comprises a laterally split body.

Another object of the invention is to construct a switching operation mechanism for a circuit breaker, which requires less mechanical effort by the user to operate on the handle of said circuit breaker.

Finally, another objective of the invention is that said preferred embodiment of the main structural components of the movement transmission of the switching operation mechanism to the circuit breaker can be integrally made in polymer or other molded material.

SUMMARY OF THE INVENTION

The aforementioned objectives are fully achieved by means of the switching operation mechanism for molded cased circuit breaker, of the type comprising at least one external operating rotating handle, capable of moving in a rotational trajectory.

According to the invention, the switching operation mechanism comprises at least one rotary handle, at least one operation member and at least one movement transmitting means, wherein said operation member of the switching operation mechanism is likely to cooperate with the operating handle of the molded case circuit breaker.

The invention stands out by the fact that the said operation member is likely to move in rotating trajectory toward equivalent to or analogous to the movement in rotational trajectory of the operating handle of the molded case circuit breaker, wherein the said movement in reversible rotational trajectory of the operation member, is able to change the position of the handle for operating the molded case circuit breaker.

BRIEF DESCRIPTION OF THE DRAWINGS

The present invention, as well as the embodiments thereof will be described in detail based on the figures listed below, including.

DETAILED DESCRIPTION OF THE DRAWINGS

Figure 1:
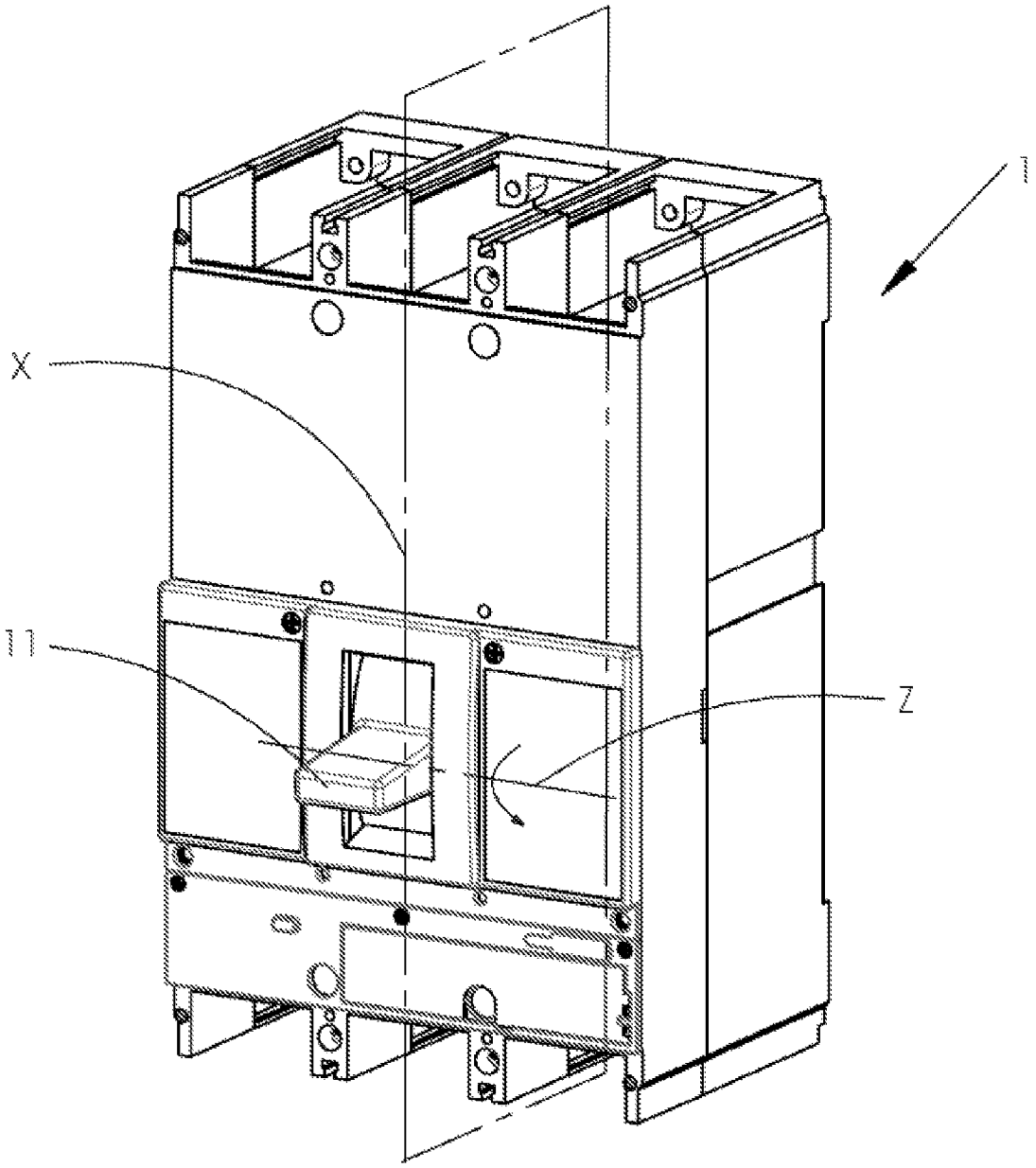
FIG. 1 illustrates, in isometric perspective, a circuit breaker in molded case and its operating handle.

FIG. 1 illustrates, in isometric perspective view, a molded case circuit breaker (1) of the prior art, of the type comprising at least one operating handle (11), positioned laterally centralized to said molded case circuit breaker (1), aligned to the plane "X", said operating handle (11) of the molded case circuit breaker (1) cited is movable in a rotational trajectory internally in a rotating schematic axis "Z".

Figure 2:
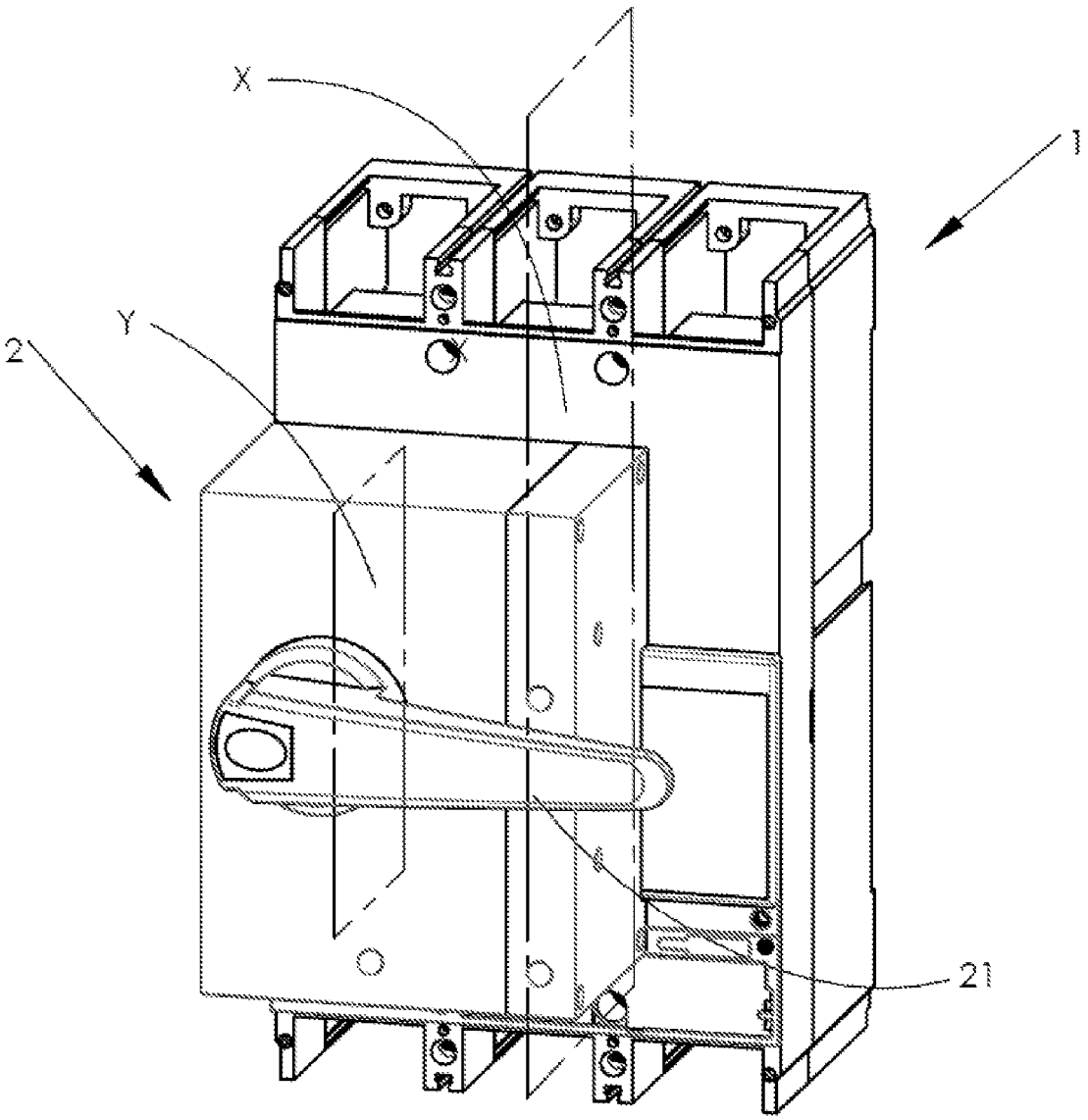
FIG. 2 illustrates, in isometric perspective, switching operation mechanism for molded case circuit breaker, according to a first preferred embodiment of the invention, coupled to the circuit breaker of FIG. 1.

FIG. 2 shows, in isometric perspective view, the switching operation mechanism (2) for the molded case circuit breaker (1), according to a first preferred embodiment of the invention coupled to the molded case circuit breaker (1) of FIG. 1, wherein the external rotary handle (21) of the switching operation mechanism (2), centralized in the plane "Y" is displaced laterally from the operating handle (11) of the circuit breaker (1) in molded case, centralized in the plane "X".

Figure 3A:
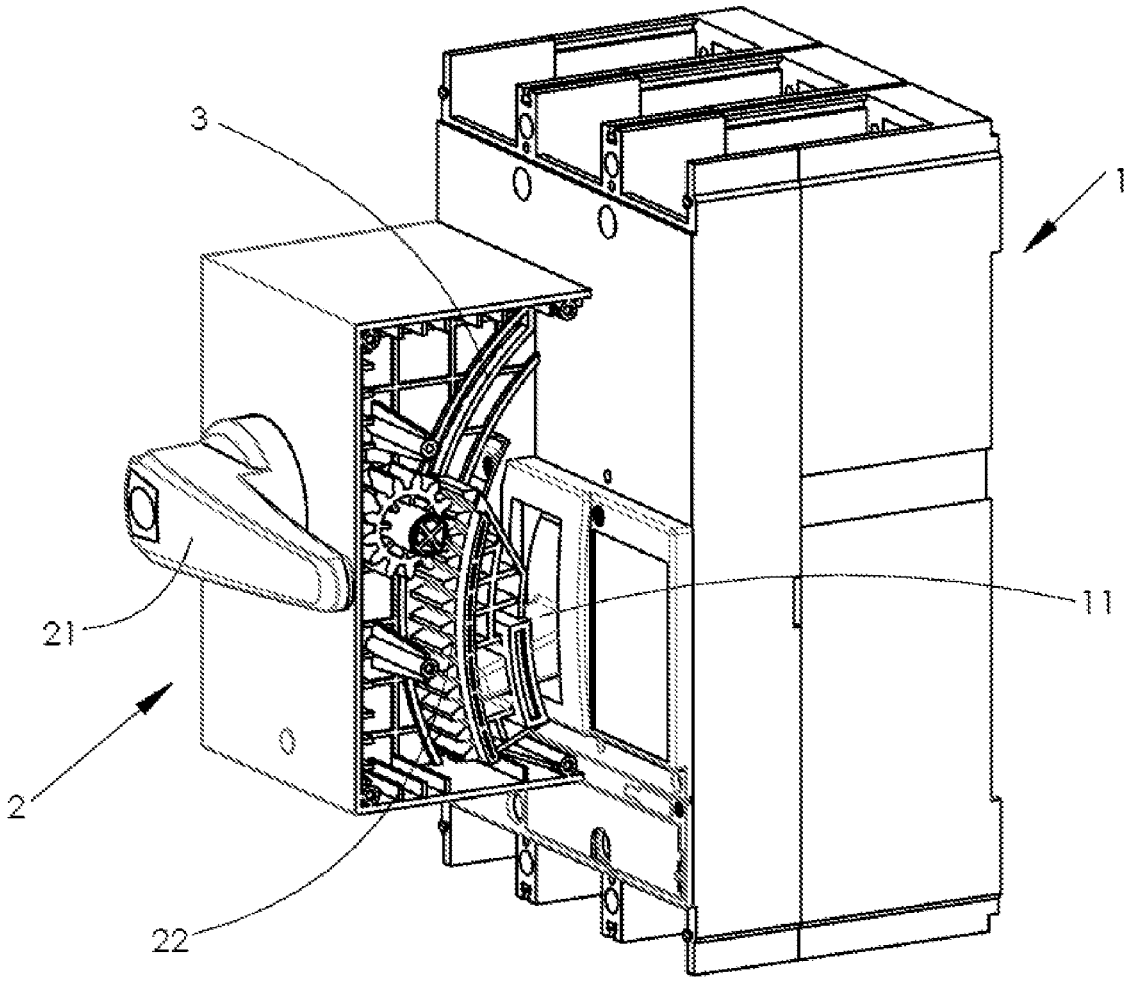
FIG. 3A illustrates, in partial section perspective view, the switching operation mechanism for circuit breaker, according to a first preferred embodiment of the invention, coupled to the circuit breaker of FIG. 1, in switched off position.

FIG. 3A illustrates, in partial perspective section view, the switching operation mechanism (2) coupled the molded case circuit breaker (1) illustrated in FIG. 1, according to a first preferred embodiment of the invention, where in detail a side partial cut view of the switching operation mechanism (2), it can be observed a rail (3) and a operation member (22), both in semicircular or arch shape, positioned in the lower region, coupled to the handle (11) of the circuit breaker (1) in a molded case, in the switched off position, among other movement transmission components.

Figure 3B:
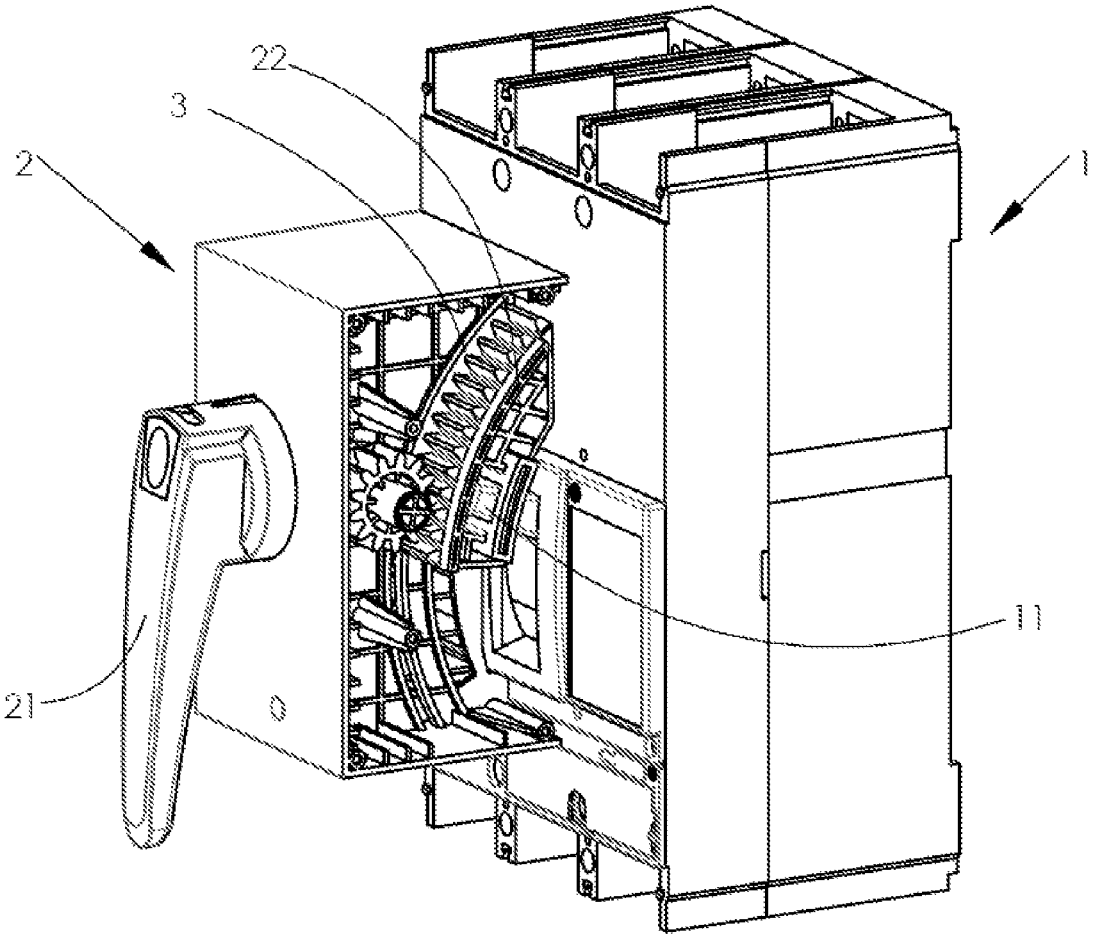
FIG. 3B illustrates, in partial section perspective view, the switching operation mechanism to circuit breaker, according to a first preferred embodiment of the invention, coupled to the circuit breaker illustrated FIG. 1, in switched on position.

FIG. 3B illustrates, in partial perspective section view, the switching operation mechanism (2) coupled to the circuit breaker (1) in molded case illustrated in FIG. 1, according to a first preferred embodiment of the invention, where in detail a side partial cut view of the switching operation mechanism (2), it can be observed a rail (3) and a semicircular or arch-shaped operation member (22) positioned in the upper region, coupled to the handle (11) of the molded case circuit breaker (1), in the switched on position, among other movement transmission components.

Figure 4A:
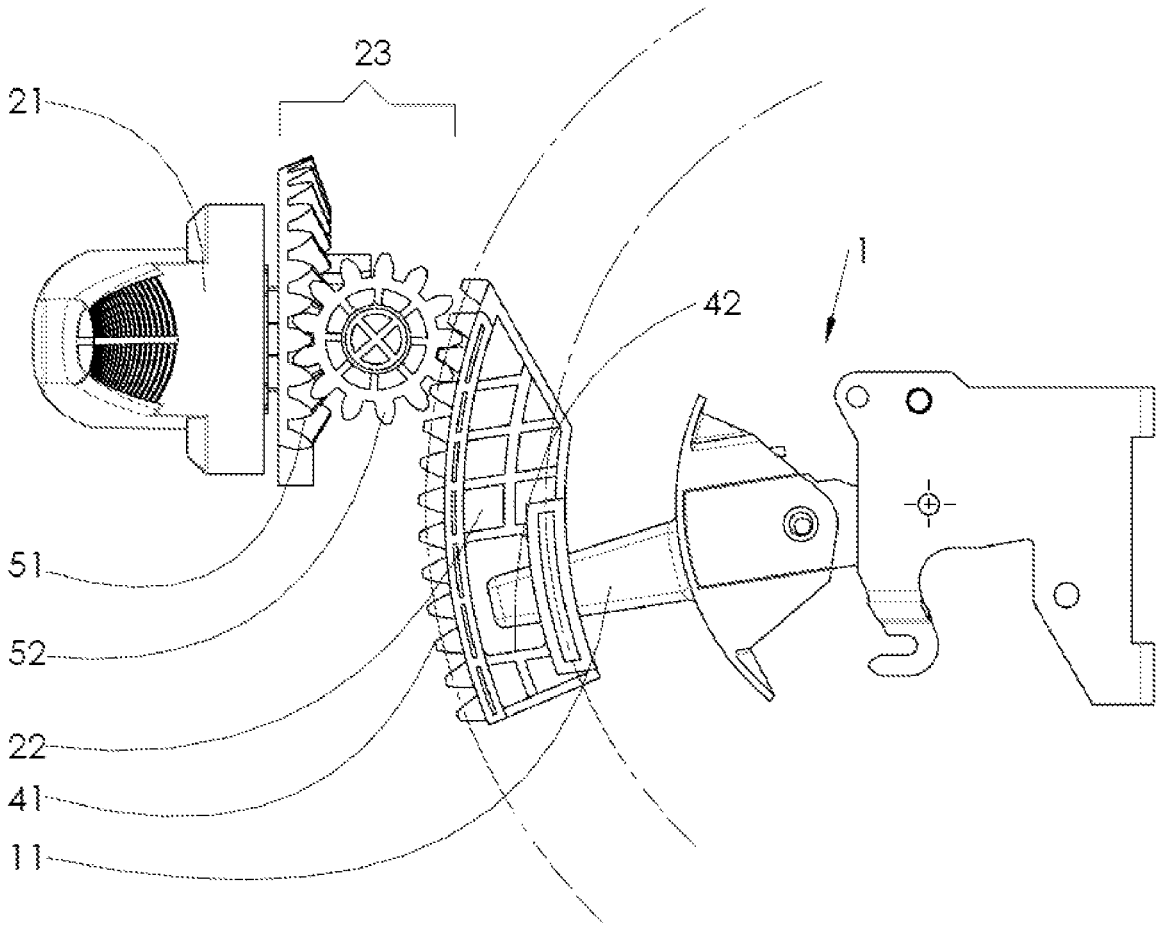
FIG. 4A illustrates, schematically, conceptually and correlated to FIG. 3A, the operating principle of the switching operation mechanism to circuit breaker, according to a first preferred embodiment of the invention, said circuit breaker in switched off position.

FIG. 4A illustrates, schematically, conceptually and correlated to FIG. 3A, the operating principle of the switching operation mechanism (2) to the molded case circuit breaker (1), according to a first preferred embodiment of the invention, where it can be observed that it is coupled to the handle (11) of the molded case circuit breaker (1), wherein the transmission member (22), comprising a face provided with gear teeth (41), sliding on an operation rail (3), also coupled to the movement transmission means (23), comprising teeth (51) and (52), connects the external rotary handle (21) in the switched off position.

Figure 4B:
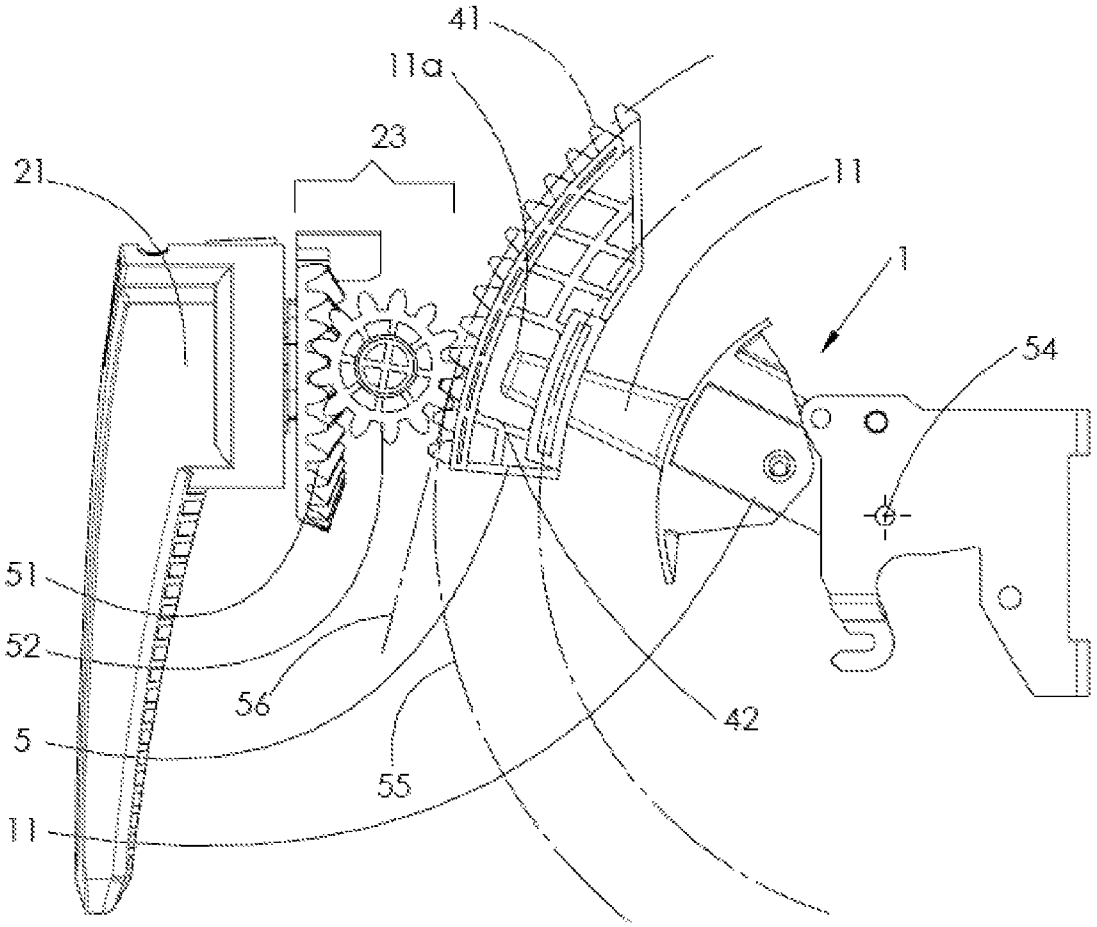
FIG. 4B illustrates, schematically, conceptually and correlated to FIG. 3B, the operating principle of the switching operation mechanism to circuit breaker, according to a first preferred embodiment of the invention, said circuit breaker in switched on position.

FIG. 4B shows, schematically, conceptually and correlated with FIG. 3B, the operating principle of the switching operation mechanism (2) for the molded case circuit breaker (1), according to a first preferred embodiment of the invention, wherein it can be observed that it is coupled to the handle (11) of the molded case circuit breaker (1), wherein the transmission member (22), comprising teeth (41), slides on an operation rail (3), also coupled to the movement transmission means (23), comprising teeth (51) and (52), connects to the external rotary handle (21) in the switched on position. It can be observed the position of the teeth (41) and a line of action (56), tangential to a primitive diameter (55), wherein a transmission force is applied by the gear (52) on the operation member (22), which is away from the center of rotation (54) relative to the end (11*a*) of the handle (11).

Figure 5:
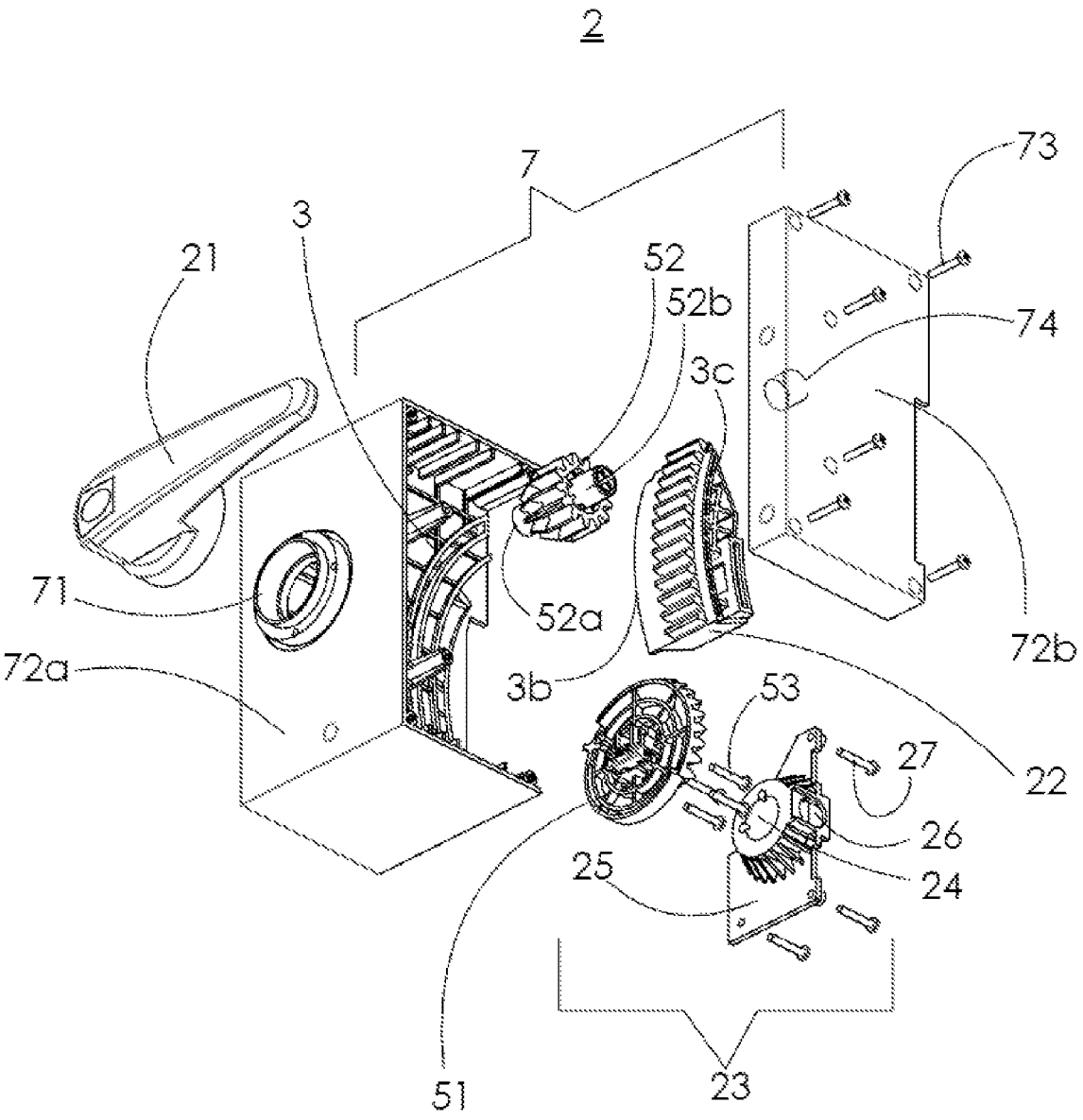
FIG. 5 illustrates, in exploded perspective view, the preferred embodiment of the switching operation mechanism to circuit breaker, according to a first preferred embodiment of the invention.

FIG. 5 shows, in exploded perspective view, the switching operation mechanism (2) to the molded case circuit breaker (1), comprising an external rotary handle (21) communicating with movement transmission means (23), as seen in FIGS. 4A and 4B, comprising a first gear (51), concentrically fixed to the handle (21) by attaching means (53), a second gear (52) and a operation member (22), which are housed in a housing (7), comprising a body (72*a*) and a detachable side lid (72*b*) and attaching means (73). Said gear (51) of said transmission means (23) being bearing-made to a hole (71) passing through said housing (7), secured through the attaching means (53) for fixing to the external rotary handle (21) at one side and on the other side through a hole (24) in the support (25). Said second gear (52) being bearing-made through its shaft (52*a*) through a hole (26) on the support (25) fixed to said body (72*a*) of the housing (7) by attaching means (27) at the one side, and on the other side through its shaft (52*b*) to a hole (74) on the detachable side lid (72*b*) of the housing (7), best observed in FIG. 8. Said operation member (22), bearing-made by an edge (3*b*) on slide rails (3) on the body (72*a*) of the housing (7) on one side, and the other side by another edge (3*c*) on sliding rails (3*a*) of the side detachable lid (72*b*) of the housing (7), best observed in FIG. 8, according to a first preferred embodiment of the invention.

Figure 6:
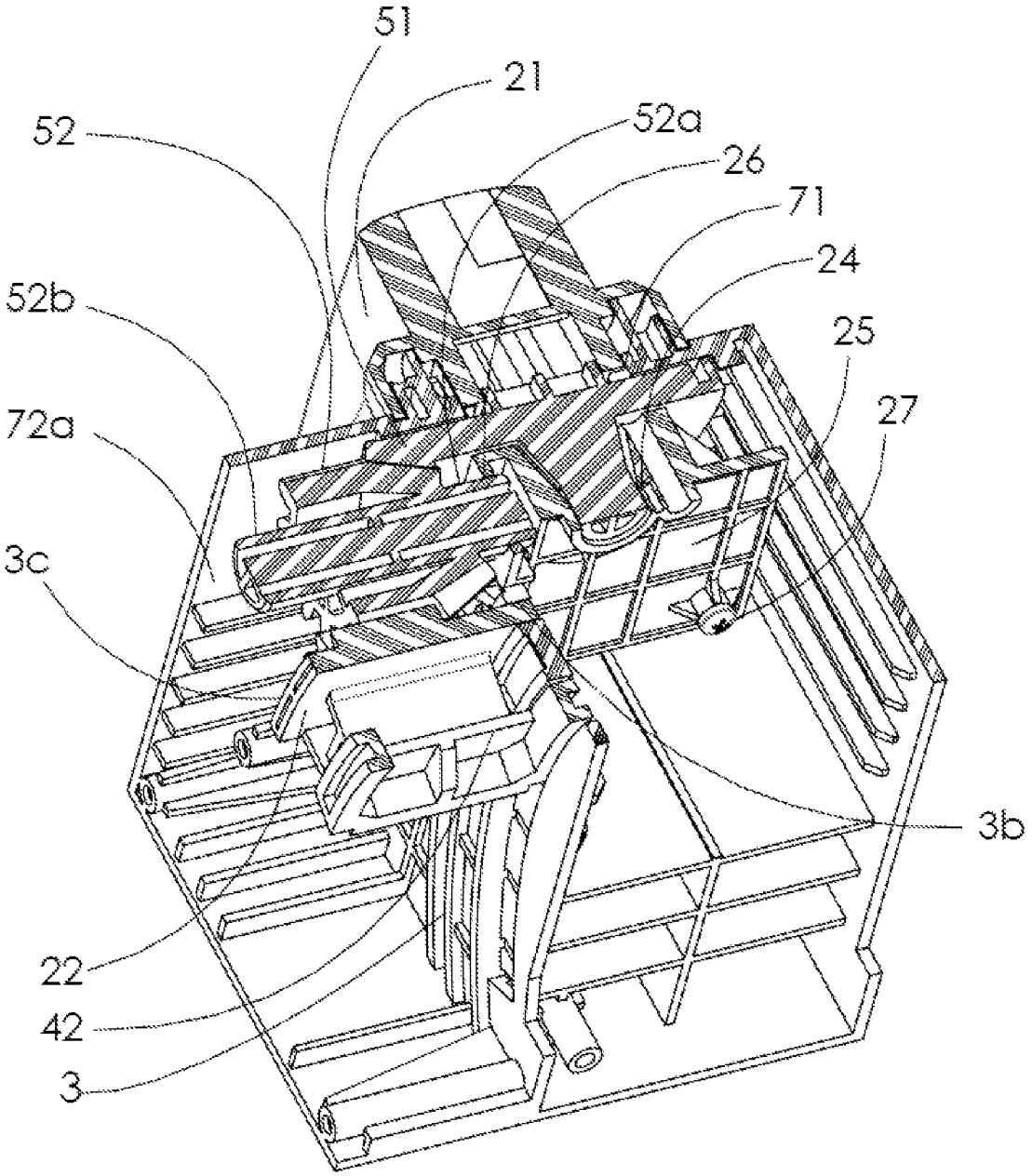
FIG. 6 illustrates, in perspective view, a partial section of the operation mechanism and its assembled internal components, for the molded case circuit breaker.

FIG. 6 shows, in perspective, a partial cross-section view of the operation mechanism (2) and its assembled internal components, for the circuit breaker (1) in molded case, comprising an external rotary handle (21) communicating with a movement transmission means (23), shown in FIGS. 4A and 4B, comprising a first gear (51), a second gear (52) and a operation member (22), which are housed in a housing (7). Said gear (51) of said transmission means (23) is bearing-made to a hole (71) passing through said housing (7) secured by attaching means (53), as seen in FIG. 5, to the external rotary handle (21), and on the other side through a hole (24) on the support (25), which is fixed to the body (72*a*). Said second gear (52) being bearing-made through its axis (52*a*) by a hole (26) on the support (25) fixed to said body (72*a*) of the housing (7) by attaching means (27) at one side, and at another side through its axis (52*b*) to a hole (74) in the detachable side lid (72*b*) of the housing (7), best seen in FIG. 8. Said operation member (22) is bearing-made by an edge (3*b*) on sliding rails (3) on the body (72*a*) of the housing (7) on one side, and on the other side by another edge (3*c*) on sliding rails (3*a*) of the detachable side lid (72*b*) of the housing (7), best seen in FIG. 8, according to a first preferred embodiment of the invention.

Figure 7:
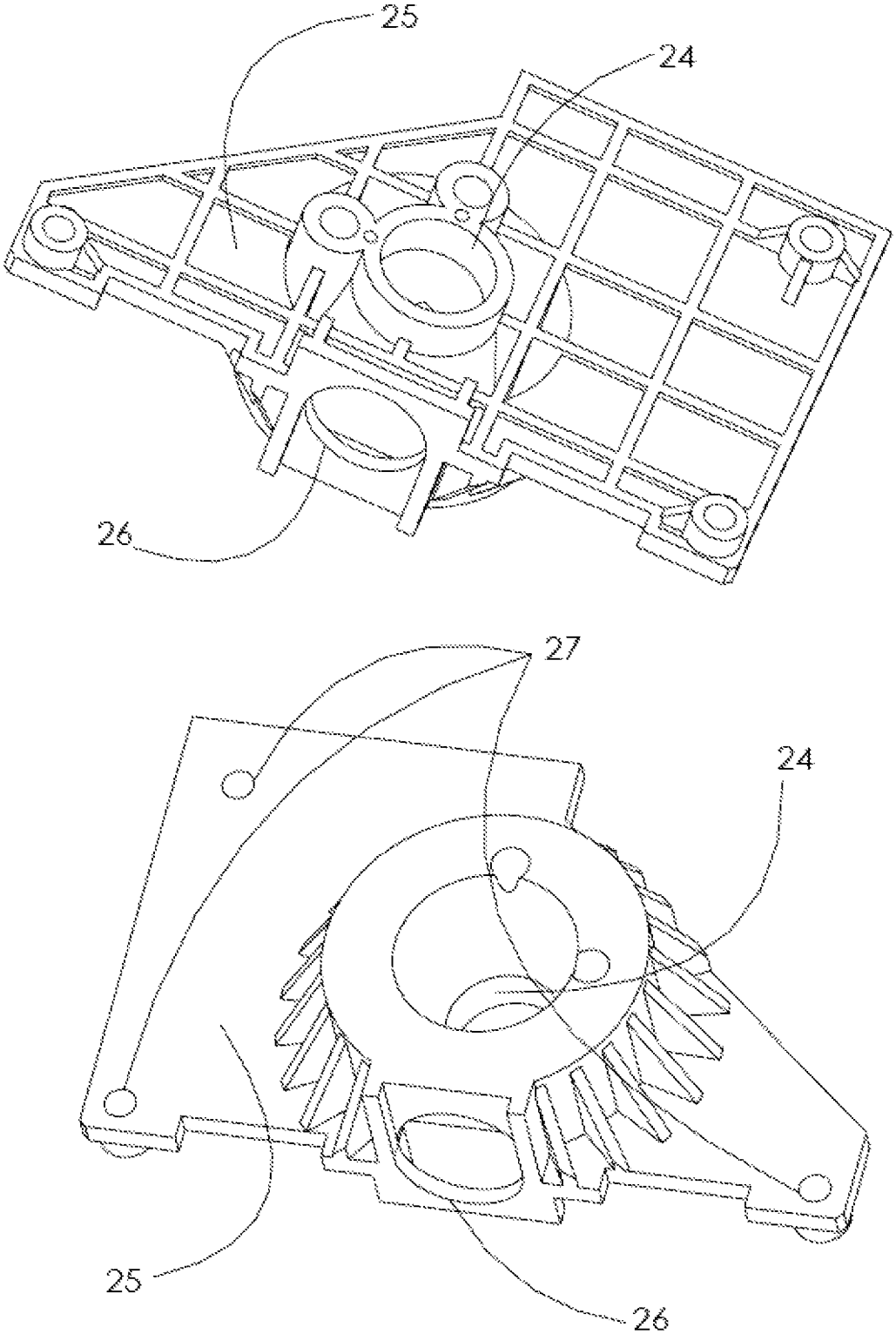
FIG. 7 illustrates, in perspective view, front and rear the support.

FIG. 7 illustrates, in perspective, front and rear view, the support (25), comprising a hole (24) and a hole (26) and their attaching holes (27).

Figure 8:
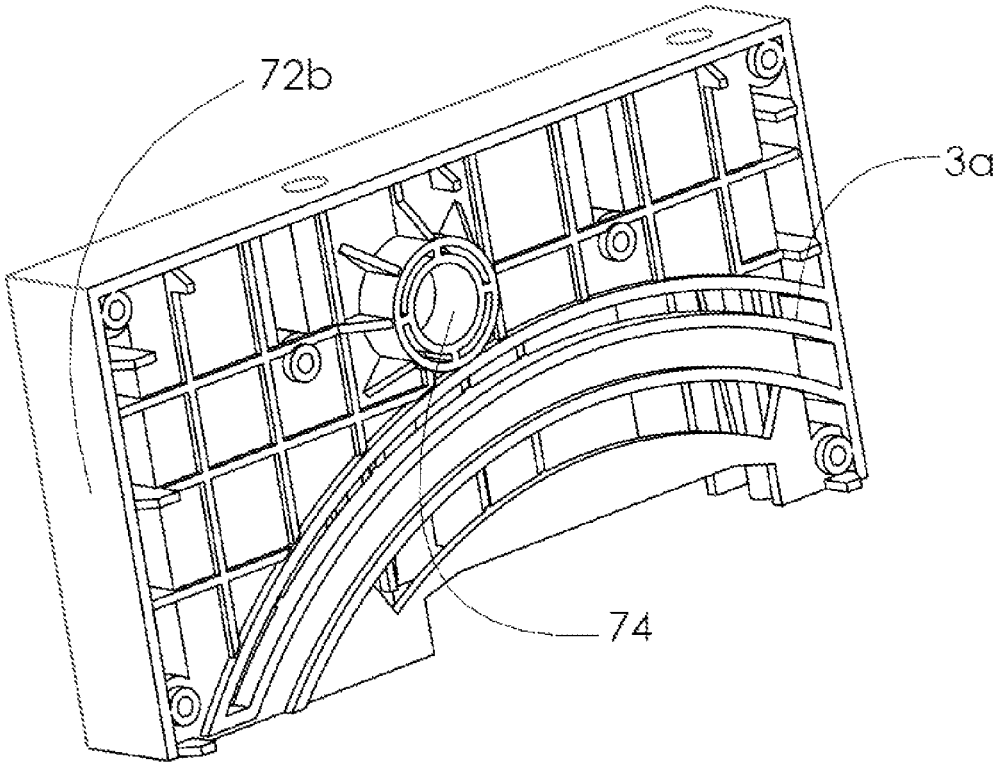
FIG. 8 illustrates, in side perspective view, the side lid detachable of the housing of the switching operation mechanism.

FIG. 8 illustrates, in perspective view, the detachable side lid (72*b*) comprising a bearing-made hole (74) of the second gear (52) and sliding rails (3*a*) to the edge (3*c*) of the operation member (22) seen in FIG. 6.

Figure 9:
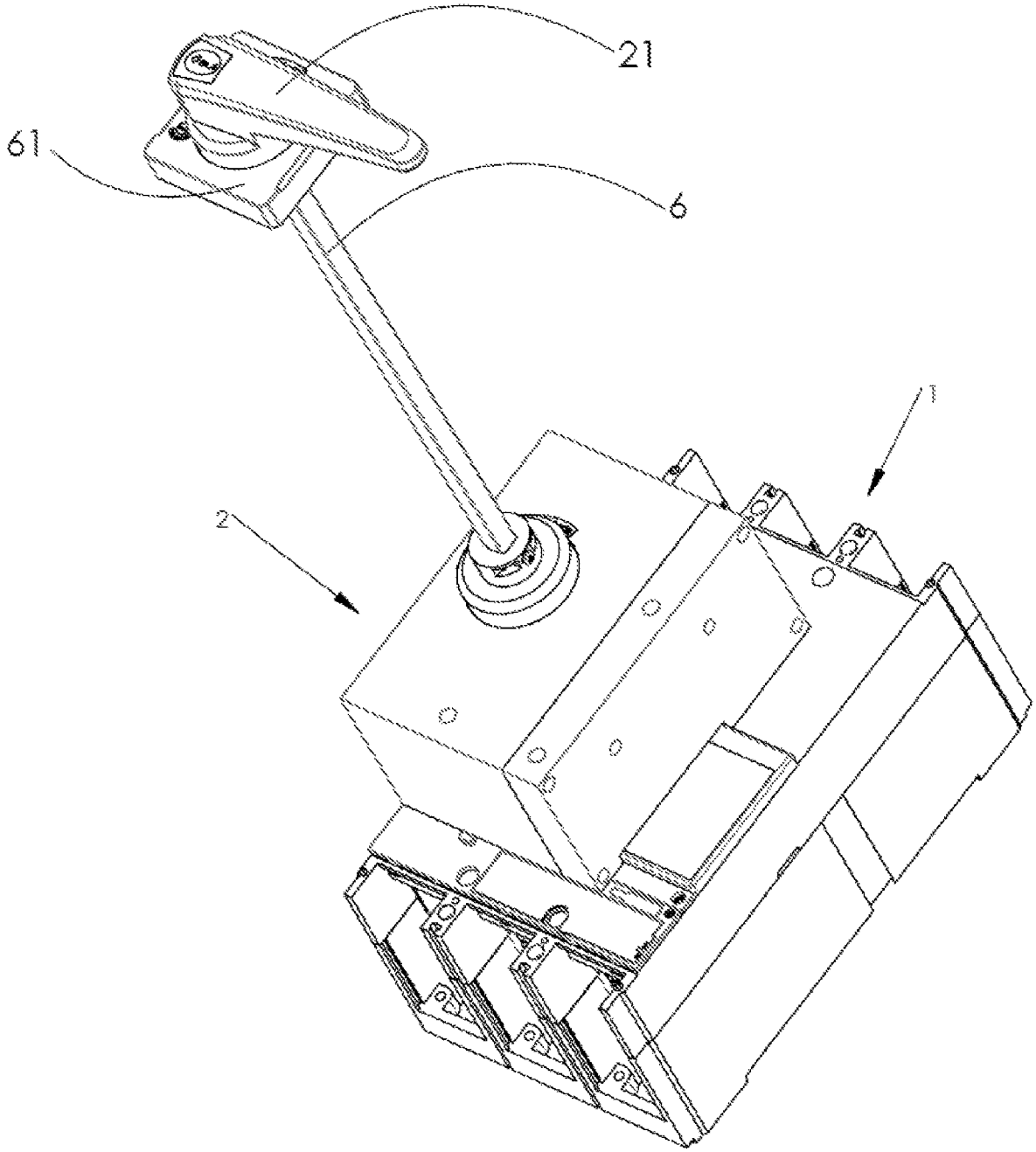
FIG. 9 illustrates, in perspective view, the switching operation mechanism to circuit breaker, according to a second preferred embodiment of the invention, comprising an extension shaft and a frame.

FIG. 9 illustrates, in perspective view, the switching operation mechanism (2) for the molded case circuit breaker (1), comprising an extension shaft (6) and a frame (61) for operating interface with the user for applications in protective panel housings, according to a second preferred embodiment of the invention.

OPERATION OF THE INVENTION

Preliminarily, it is worth clarifying that the subject matter of the invention, the switching operation mechanism (2), is especially designed to a molded case circuit breaker (1), of the type comprising an operating handle (11), movable in rotational trajectory, as shown in FIG. 1. In this sense, it is worth clarifying that this type of molded case circuit breaker (1) is widely known to those skilled in the art, wherein the operating handle (11) normally allows modification of the operating positions "switched off", "switched on" manually and in from the "triggered" position, automatically by means of the internal trigger mechanism of the molded case circuit breaker (1). As shown in FIG. 2, said switching operation mechanism (2), object of the invention, is associated with a molded case circuit breaker (1), which is operated indirectly by the external rotary handle (21) of said switching operation mechanism (2) in place of the operating handle (11) of the molded case circuit breaker (1). In this sense, it is also worth clarifying that the general concept of operating the handle (11) for operating the molded case circuit breaker (1) by means of a rotary handle (21) of a switching operation mechanism (2) is also already widely known to those skilled in the art. For the operation of said switching operation mechanism (2), it should comprise, at least one operation member (22) and at least one movement transmission means (23) associated to said rotary handle (21), the said operation member (22) of switching operation mechanism (2) being liable to transmit the movement of the external rotary handle (21) to the operating handle (11) of the molded case circuit breaker (1).

Having as base the cited FIGS. 4A and 4B, it is clear to observe the functional principle of the invention, i.e., any torque being applied by a user to the external rotary handle (21) of the switching operation mechanism (2) clockwise or counter-clockwise sense, typically wherein such torque is transmitted by the movement transmission means (23) to the operation member (22), which moves on the rail (3), acting directly on the operating handle (11) of the molded case circuit breaker (1), in order to change its operating position, from a first "switch off" position as seen in FIGS. 2, 3A and 4A to a "switch on" position, as seen in FIGS. 3B and 4B. It is to be noted that the movement of at least one operating handle (11) of the molded case circuit breaker (1) cited capable of moving in a rotational trajectory internally, internally in a rotating axis "Z", such movement being due to its internal operation mechanism, which carries out the opening and closing of its electrical circuit contacts (not shown), and observable in an "X" plane, seen in FIG. 1. When the movement of an external rotary handle (21) of the switching operation mechanism (2) to the molded case circuit breaker (1) is reported, the movement said as rotational is observed in the front operating plane.

In this regard, and aiming to solve the technical problems previously mentioned, it is an object of the invention the operation member (22) being rotably moveable in rotational trajectory towards equivalent direction to the of the rotational trajectory movement of the operation handle (11) of the of the molded case circuit breaker (1). Evidently, the movement of the operation member (22), which is imposed by the movement of the external rotary handle (21) is responsible for changing the position of the handle (11) for operating the molded case circuit breaker (1).

According to a first preferred embodiment of the switching operation mechanism (2), as shown in FIGS. 2, 3A, 3B, 4A, 4B, 5 and 6, it will be appreciated that the entire movement, or at least a portion of the rotational trajectory of movement of the operation member (22), comprises a semicircular path. More particularly, it is noted that especially in the FIGS. 3A, 3B, 5 and 6, all movement of said operation member (22) occurs on a rail (3).

This means that the switching operation mechanism (2), according to the preferred embodiment of the invention, comprises a rail (3) whose rotational trajectory is equivalent to the rotational trajectory of the operating handle (11) of the molded case circuit breaker (1).

With this, an efficient transfer of movements is achieved, after all, practically the totality of the torque applied on the operation member (22) is also applied to the operating handle (11) of the molded case circuit breaker (1).

In addition, the switching operation mechanism (2) in accordance with the original concept of the present invention also enables misalignment between the laterally centralized position of the operating handle (11) of the molded case circuit breaker (1) in the plane "X" and the position laterally displaced of the external rotary handle (21) of the switching operation mechanism (2) in "Y" plane. Accordingly, the invention also overcomes the problems related to the preferred dimensions that an external rotary handle must have so that an average user is able to effectively change the position of the handle (11) of the molded case circuit breaker (1). This means that it is possible to keep an external rotary handle (21), of large dimensions in proportion to the assembled assembly, still "inside" the general perimeter of the molded case circuit breaker (1), achieving satisfactory results, even in situations in which said molded case circuit breaker (1) comprises miniaturized dimensions and wherein it may require the application of a large lever force on the external rotary handle (21) of the switching operation mechanism (2), for moving its operating handle (11).

Another object achieved with the present invention is that the position of the teeth (41) of the operation member (22) is further away from the center of rotation (54) relative to the end (11*a*) of the handle (11), increasing the distance between the center of rotation (54) and the line of action (56), responsible for the transmission of force applied by the gear (52) on the operation member (22), requiring less proportional operational mechanical power of the user operation on the external rotary handle (21) for an equal movement of the handle (11) for operating the molded case circuit breaker (1), due to the classical mechanics concept that the greater the distance, the greater the torque, the force being maintained constant.

It can be observed the position of the teeth (41) and a line of action (56), tangential to a primitive diameter (55), where a transmission force is applied by the gear (52) on the operation member (22), which is further away from the center of rotation (54) relative to the end (11*a*) of the handle (11).

Furthermore, according to preferential embodiments of the invention, particularly as illustrated in FIGS. 3B, 4A, 4B, 5 and 6, it is verified that the operation member (22) itself comprises a generally arched body or having semicircular contour, that comprises teeth (41) of gear, which are designed to cooperate with the movement transmission means (23). In addition, the body of the operation member (22) further comprises a coupling means (42) associable to the handle (11) of the molded case circuit breaker (1). Preferably, said coupling means (42) (seen in FIGS. 4A, 4B and 6, comprises a single cavity or housing, with dimensions and shape similar or analogous to the end of the handle (11) for operating the molded case circuit breaker (1).

Also according to a first and second preferred embodiments of the invention, the movement transmission means (23), comprises a first gear (51) coupled to the external rotary handle (21) and a second gear (52), cooperating with the operation member (22), wherein the first gear (51) and the second gear (52) are both perpendicularly coupled to each other. In particular, the first gear (51) comprises a conical gear type, provided with multiple teeth arranged on its face of larger area, and the second gear (52) comprises a pinion gear type provided with multiple teeth comprising preferably a conical portion and another flat portion.

It should also be noted that, as shown in FIGS. 2 and 6, in a first preferred embodiment of the invention, the first gear (51) is directly coupled to the external rotary handle (21).

In a second preferred embodiment, where the circuit breaker (1) is assembled behind a protective or enclosed panel (not shown) as shown in FIG. 9, where the first gear (51) can be indirectly coupled to the rotary handle (21) and more particularly, the first gear (51) is indirectly coupled to the rotary handle (21) by means of an extension shaft (6) and a interface operation frame (61) with the user.

In addition, considering both the first preferred embodiment as the second preferred embodiment of the invention, it is verified that the main components that comprise the switching operation mechanism (2), the operation member (22) and the movement transmission means (23) are arranged within a housing (7), which comprises a body (72*a*) and a detachable lid (72*b*), the body (72*a*) comprising a passing hole (71), for the accommodation of the external rotary handle (21) or extension shaft (6).

In addition, and as specifically shown in FIG. 5, the said housing (7), laterally bipartite, comprises a body (72*a*) and one detachable lid (72*b*), whose fixing is given preferably by traditional attaching means (73), such as screws. This preferred characteristic has the general purpose of assisting in the assembly of all the items integrating the main components comprising the switching operation mechanism (2), the operation member (22) and the movement transmission means (23), in addition to facilitating its method of obtaining, with a greater number of internal details such as, for example, structural reinforcements, housings and bearings for the gears, best seen in FIG. 6, and even the definition of the rail (3), which comprises, in this preferred embodiment, one rib disposed on at least one of the walls integrating the switching operation mechanism (2), reducing the number of components needed for the switching operation mechanism (2) compared to the prior art.

In this sense, considering all the above, it is important to highlight that the present disclosure has the sole purpose of describing the exemplary method of preferred embodiments of the switching operation mechanism for molded case circuit breaker according to the invention. Accordingly, as is well understood by those skilled in the art, several modifications, variations and constructive combinations of the members exerting the same function in substantially the same manner to achieve the same results are possible, which should be included within the scope of protection defined by the appended claims.

The invention claimed is:

1. Switching operation mechanism for molded case circuit breaker, wherein said molded case circuit breaker comprises at least one operating handle capable of moving in a rotative trajectory;

said switching operation mechanism comprising at least one external rotary handle, at least one operation member and at least one movement transmission means; said operation member of the switching operation mechanism being capable of transmitting the movement from the external rotary handle to the operating handle for operating the circuit breaker in molded case;

said switching operation mechanism being characterized by the fact that:

said operation member sliding on a rail in an arcuate or semicircular format, for operating directly on the operating handle moving in a rotational trajectory in the direction equivalent to the movement in rotational trajectory of an external rotating handle for operating the molded case circuit breaker.

2. Switching operation mechanism for molded case circuit breaker, according to claim 1, characterized by the fact that the switching operation mechanism comprises at least one rail of rotational trajectory equivalent to the rotational trajectory of the operating handle for operating the molded case circuit breaker.

3. Switching operation mechanism for molded case circuit breaker, according to claim 2, characterized by the fact that said operation member is movable on the said rail.

4. Switching operation mechanism for molded case circuit breaker, according to claim 1, characterized by the fact that said operation member comprises:

a face provided with gear teeth; and at least one coupling means associable with said operating handle for operating the said molded case circuit breaker.

5. Switching operation mechanism for molded case circuit breaker, according to claim 1, characterized by the fact that said movement transmission means comprises:

at least one first gear coupled to said external rotary handle;

at least one second gear cooperating with said operation member; and said first gear and said second gear are perpendicularly coupled together.

6. Switching operation mechanism for molded case circuit breaker, according to claim 5, characterized by the fact that said first gear of said movement transmission means comprises a cone-shaped gear provided with multiple teeth, arranged on its face of larger area defined by a conical face.

7. Switching operation mechanism for molded case circuit breaker, according to claim 5, characterized by the fact that said second gear of said movement transmission means comprises a pinion-shaped gear provided with multiple teeth partially comprising a conical portion and another flat portion.

8. Switching operation mechanism for molded case circuit breaker, according to claim 5, characterized by the fact that said first gear is directly coupled to said external rotary handle.

9. Switching operation mechanism for molded case circuit breaker, according to claim 5, characterized by the fact that said first gear is indirectly coupled to said external rotary handle by means of an extension shaft.

10. Switching operation mechanism for molded case circuit breaker, according to claim 1, comprising said operation member, having a bearing made by an edge on slide rails on a body of a housing on one side and the other side by another edge on sliding rails of a side detachable lid of the housing.

11. Switching operation mechanism for molded case circuit breaker, according to claim 1, characterized by the fact that the external rotary handle of the switching operation mechanism is centralized in a plane "Y" displaced laterally from the operating handle of the molded case circuit breaker which is centralized in the plane "X," wherein the operation mechanism is coupled to the molded case circuit breaker and fits lateral dimensions of the molded case circuit breaker.

* * * * *